United States Patent [19]

Lynch et al.

[11] Patent Number: 4,813,498

[45] Date of Patent: Mar. 21, 1989

[54] ACTIVE COUNTERBALANCE FOR A POWER SWIVEL DURING WELL DRILLING

[75] Inventors: James E. Lynch, Dallas; David B. Ford, Frisco, both of Tex.

[73] Assignee: National-Oilwell, Houston, Tex.

[21] Appl. No.: 163,580

[22] Filed: Mar. 3, 1988

[51] Int. Cl.[4] ..... E21B 19/06

[52] U.S. Cl. ..... 175/113; 173/44

[58] Field of Search ..... 175/113, 162, 203; 166/77.5, 85; 173/42, 43, 44, 164

[56] References Cited

U.S. PATENT DOCUMENTS

| | | | |
|---|---|---|---|
| 2,712,932 | 7/1955 | Gould | 267/70 |
| 3,037,803 | 6/1962 | Phillips | 294/82 |
| 3,766,991 | 10/1973 | Brown | 173/20 |
| 3,792,787 | 2/1974 | Maloney | 214/152 |
| 3,838,613 | 10/1974 | Wilms | 81/57.34 |
| 3,942,592 | 3/1976 | Hodge | 173/157 |
| 4,121,806 | 10/1978 | Jato et al. | 254/172 |
| 4,251,176 | 2/1981 | Sizer et al. | 414/22 |
| 4,589,503 | 5/1986 | Johnson et al. | 175/85 X |
| 4,593,773 | 6/1986 | Skeie | 175/85 |

*Primary Examiner*—William P. Neuder

*Attorney, Agent, or Firm*—R. J. Bunyard; R. H. Johnson; L. A. Fillnow

[57] ABSTRACT

An active counterbalance for suspending a power swivel from a traveling block. The power swivel includes a motor drive assembly for rotating a drill string and a handling system for supporting a drill pipe. The counterbalance includes a motor which provides means for biasing the load capacity of the counterbalance when supporting the power swivel to allow vertical displacement of the power swivel relative to the traveling block. The counterbalance prevents damage to connecting or sealing surfaces when adding pipe to or removing pipe from the drill string because most of the weight of the power swivel and pipe suspending from the handling system is transferred to the counterbalance.

23 Claims, 7 Drawing Sheets

ACTIVE COUNTERBALANCE FOR A POWER SWIVEL DURING WELL DRILLING

BACKGROUND OF THE INVENTION

This invention relates to a top driven drilling machine for use in a derrick and a method for preventing damage to the threaded ends of drill pipe. More particularly, the invention provides for lowering the pipe and contacting a drill string for connection without damaging impact. The invention also includes pulling the pipe away from the drill string and preventing rebound impact when removing the drill string from a well.

Conventional rotary drilling requires the use of a rotary table, a motor mounted on or below the rig floor for rotating the table, and a kelly for rotationally connecting the table to the drill string. In recent years, these drilling units are being replaced by or retrofitted with top driven drilling systems which rotate the drill string by a motor suspended within a standard derrick or mast from a traveling block.

Hereafter, these top driven machines will be referred to as a power swivel. The drilling motor is connected to the drill string by a cylindrical stem or sub assembly extending downwardly within the derrick from the drill motor. Drilling is accomplished by the powered rotation of the drill string. A cutting tool or bit is placed at the bottom end of the drill string which, through the rotational energy supplied by the drill motor, cuts through the earth's formations and deepens a well. As the well is drilled, the bit becomes worn and must be replaced periodically. When replacement of the bit becomes necessary, if the well needs to be surveyed, or the well needs to be lined with casing, a portion of the drill string corresponding in length to one or more sections of drill pipe must be removed from the well and pulled above the rig floor. This portion of the drill string is removed and stored on the rig. The drill string is again pulled from the well exposing the next section above the floor and is similarly removed. This sequence, usually referred to as tripping out, is continued until the entire drill string is removed from the well. After the bit is replaced, the surveying is completed or the casing set, the drill string is reassembled; i.e. tripping in, by connecting all the pipe sections previously removed.

For drilling equipment utilizing a power swivel, the pipe handling operation is controlled remotely from a console on the derrick platform. Because the drilling unit is large and somewhat cumbersome to handle, the threads on the sub assembly or pipe ends frequently become damaged when connecting or disconnecting the individual pipe stands from the sub assembly of the power swivel or the drill string. When their threads become damaged, the sub assembly or pipe must be temporarily taken out of service until the threads can be remachined to serviceable condition. This increases the costs of drilling because of delay time, reconditioning costs, and the increased inventory of drill pipe required. Furthermore, pipe having damaged thread and not taken out of service for repair could result in washout of the threads as well as a separation of the drill string inside the well bore.

A stand of drill pipe may include as many as three sections of pipe. When a drill string must be removed from a well, a traveling block vertically lifts the drill string from the well a distance above the floor of the drilling rig corresponding to a length of the stand of pipe. The weight of the drill string is then supported by wedges or slips located at the floor of the drilling rig. The top stand of drill pipe is removed from the drill string normally by first disconnecting the sub assembly from the top end of the pipe. A wrench assembly or tongs is used to hold and prevent rotation of the dril pipe when rotating or "spinning out" the sub assembly from the top end of the drill pipe. As the sub assembly becomes threadably disengaged from the drill pipe, the upward tension of the power swivel causes the sub assembly to be pulled away from the drill pipe. However, the sub assembly could impact against the top end of the drill pipe if there is a rebound after disengagement. Similar impact may occur when reassembling drill pipe to the drill string and when connecting the sub assembly to the top end of the drill pipe. Since the point of connecting the sub assembly to the drill pipe is well above the floor of the drilling rig, the operator's line of sight may be obscured. Furthermore, the control system for remotely operating the power swivel lacks sensitivity to quickly stop the traveling block when lowering the power swivel. These impacts usually result in damaged threads or damaged sealing surfaces, either of which requires removal of the damaged item from service.

There have been many attempts over the years to provide cushioning devices to prevent thread damage when "spinning out" or "spinning in". However, these devices do not provide cushioning for both operations. More importantly, these cushioning devices have not completely eliminated impacts because thread damage still occurs. U.S. Pat. No. 2,712,932 discloses a telescoping cushioning device including a helical compression spring positioned within a cylinder. The cylinder is positioned at the top end of a stand of pipe to be connected to a drill string. If the stand of pipe impacts the drill string when lowered, the weight of the pipe compresses the spring. U.S. Pat. No. 3,766,991 discloses a power swivel utilizing shock absorbers enabling smooth handling of pipe. The hangers for the swivel are formed by hydraulic cylinders. The upward movement of the power swivel resulting when the pipe section is unthreaded is compensated for by the downward movement of a piston under the cushioning pressure of a fluid. This assures smooth release of the threads without sudden upward jumping of the power swivel when the last thread is released. U.S. Pat. Nos. 3,838,613 and 4,251,176 disclose the use of counterbalance valves for weight compensation when adding or removing pipe from a drill string.

Nevertheless, the above described passive cushioning or counterbalance devices lack the sensitivity to completely eliminate the impact problem. Furthermore, these devices generally do not provide the same degree of thread protection during both pipe handling situations discussed above. There remains a long felt need for a device which will reduce impact and thread damage both when making and breaking connections between drill pipe and a sub assembly or between drill pipe and a dril string. Our inventin overcomes this problem by providing an active counterbalance wherein the load capacity of the counterbalance is adjusted depending on whether pipe is being removed or added to a drill string. The weight of the power swivel is known. When adding pipe to the drill string, the load capacity of the counterbalance is adjusted to slightly greater than the weight of the power swivel. Suspending the pipe from the power swivel displaces downwardly the power swivel to a full extended position. As the stand of pipe is lowered and contacts the drilling string, the power swivel is displaced upwardly to a retracted position preventing overloading of the threads. As the pipe is threaded into the drill string, the power swivel is displaced downwardly toward the extended position. The load capacity of the counterbalance is now adjusted to slightly less than the weight of the power swivel. The power swivel continues to be lowered until the subassembly contacts the upper end of the drill pipe. The sub assembly is displaced upwardly toward the retracted position preventing overloading of threads or sealing surfaces. As the sub assembly is then threaded into the drill pipe, the sub assembly is displaced downwardly toward the extend position. When a drill pipe is to be removed from a drill string, the load capacity of the counterbalance is adjusted to slightly greater than the weight of the power swivel while the counterbalance is fully extended. The drill pipe is held to prevent rotation while the sub assembly is rotated. As soon as the sub assembly is disengaged from the upper end of the drill pipe, the upward tension of the counterbalance pulls the power swivel away from the drill pipe without rebound or impact.

BRIEF SUMMARY OF THE INVENTION

Our invention includes a power swivel for rotation of a drill string, means for supporting the power swivel within a derrick, an active counterbalance for suspending the power swivel from the support means and method for assembling the drill string without high loading or sudden impact between threaded ends or sealing surfaces. The power swivel includes a motor drive assembly for rotating the drill string and a handling system for supporting a drill pipe. The counterbalance includes a motor that is responsive to changes of force. The motor includes means for biasing the load capacity of the counterbalance when suppoting the power swivel thereby providing for vertical displacement of the power swivel relative to the support means. The method includes adjusting the supporting force on the motor so that the load capacity of the counterbalance is just less than the weight of the power swivel thereby displacing downwardly the biasing means to a first position. The power swivel is lowered into contact with the drill pipe wherein the power swivel is displaced upwardly relative to the support means from the lower first position to an upper second position so that the contact load on the drill pipe during the displacement is substantially less than the weight of the power swivel. The power swivel is then threadably connected to the drill pipe. When disconnecting the power swivel from the drill pipe, the load capacity of the counterbalance is adjusted so that the supporting force is greater than the weight of the power swivel. When the power swivel is disengaged from the drill pipe, the biasing means is displaced upwardly toward the second position thereby pulling the power swivel away from the drill pipe.

It is a principal object of our invention to make a threaded connection between a power swivel and a drill pipe without high loading or impact.

It is another object of our invention to disconnect a power swivel from a drill pipe without rebound impact.

Advantages of our invention are reduced costs by minimizing sub assembly and pipe thread repair, pipe inventory, extending the life of tool joints, and minimizing down-hole trouble due to damaged tool joints.

The above and other objects, features and advantages of our invention will become apparent upon consideration of the detailed description and appended drawing.

DETAILED DESCRIPTION OF THE PREFERRED EMBODIMENT

Figure 1:
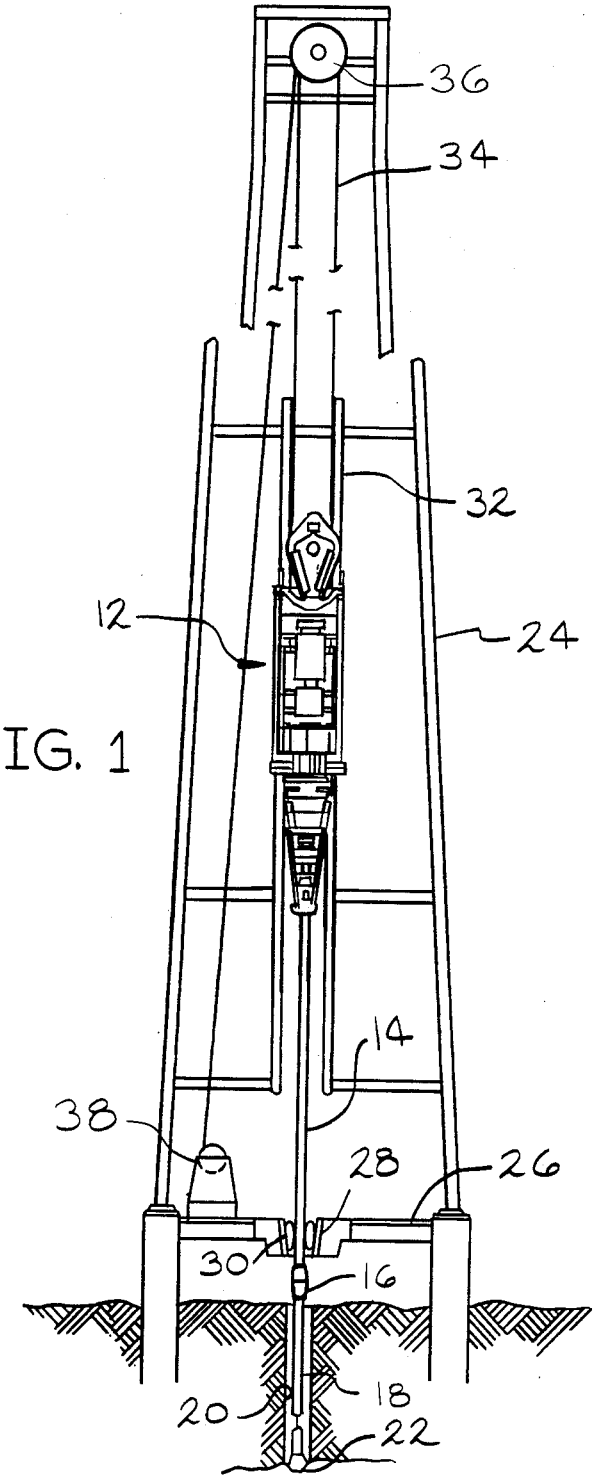
FIG. 1 is a schematic view of a top drive drilling unit incorporating our invention.

Referring to FIG. 1, reference numeral 12 denotes a schematic of a top driven drilling machine, hereafter referred to as a power swivel. Power swivel 12 is suspended from a crown block 36 within a derrick or mast 24, hereafter referred to as a derrick, by a rope 34 reeved over block 36 and wound around a drawworks 38. Derrick 24 includes a rig floor 26, a slip bowl 28 and slips 30. A drill string 18 having a drill bit 22 threadably connected to the bottom thereof extends downwardly into a well 20. Drill string 18 is threadably connected to power swivel 12 by a drill pipe 14 connected at a tool joint 16. Power swivel 12 is operated remotely from a console (not shown) on rig floor 26 for simultaneous powered rotation of drill string 18 and vertical movement along a pair of guide tracks 32.

Figure 2:
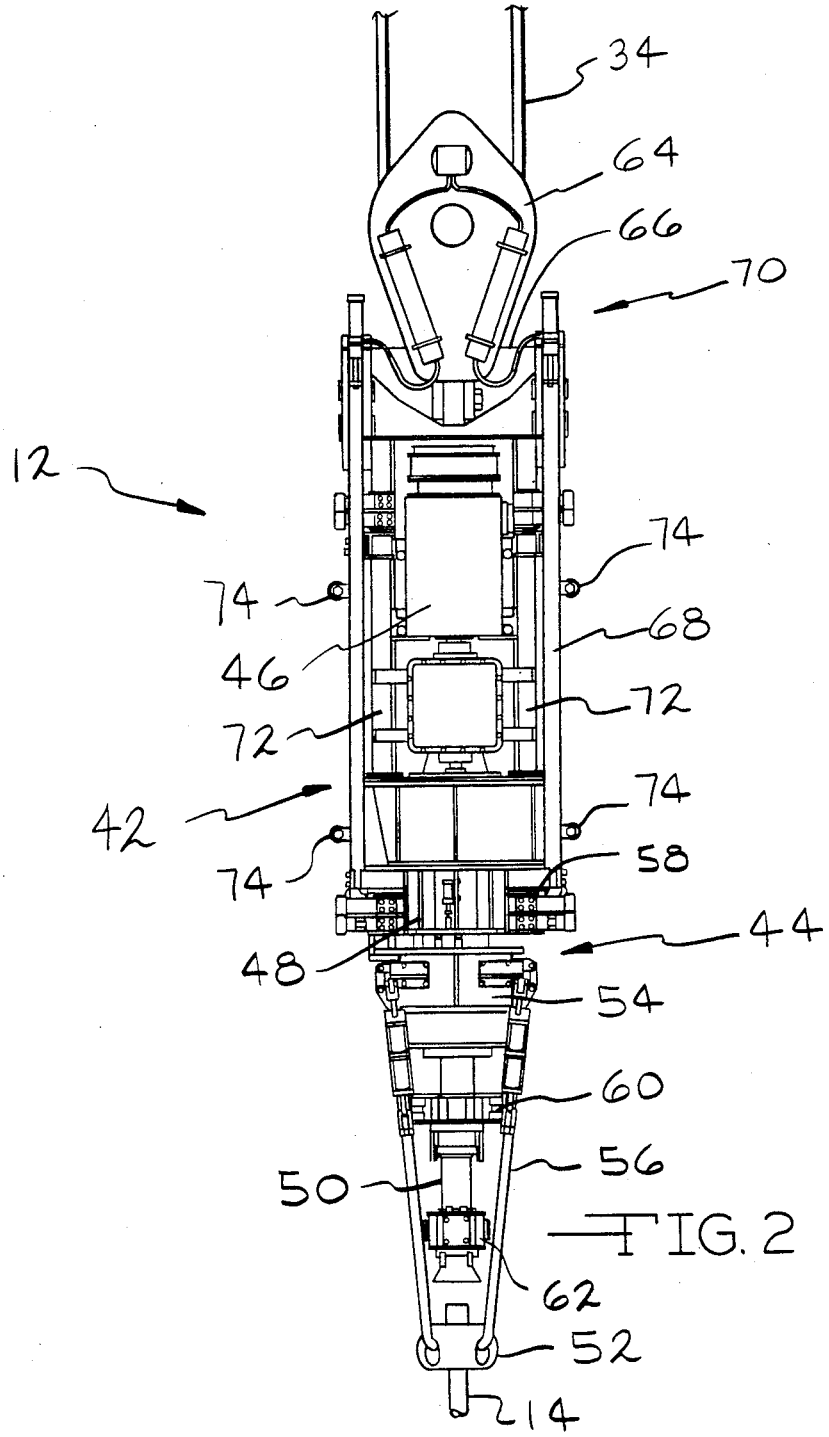
FIG. 2 is an elevation view of the power swivel of FIG. 1.
Figure 3:
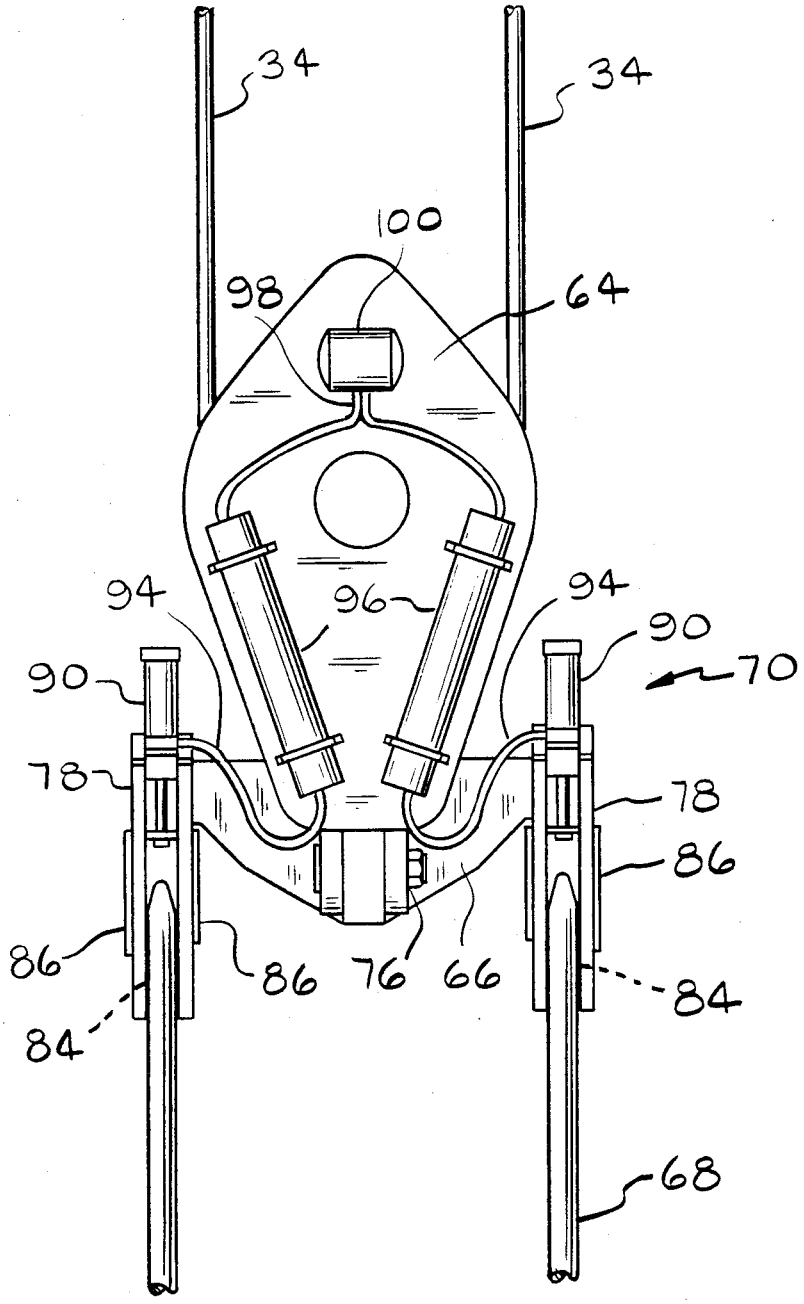
FIG. 3 is a local view of the counterbalance in FIG. 2 incorporating a preferred embodiment of our invention.
Figure 4:
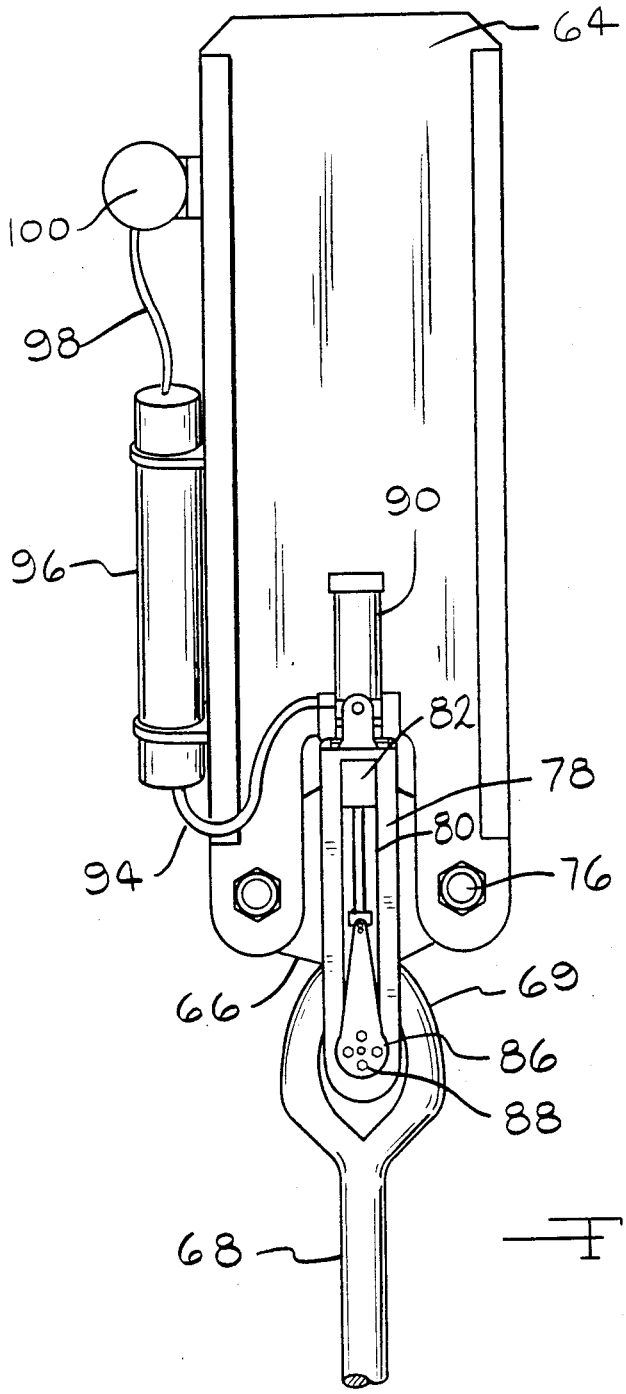
FIG. 4 is a side view of the counterbalance shown in FIG. 3.

Details of power swivel 12 are illustrated in FIG. 2. Power swivel 12 generally includes a motor drive assembly 42 and a handling system 44. Motor drive assembly 42 includes a drill motor 46, a swivel bearing 48, and a sub assembly 50 for threadable connection to drill pipe 14. Handling system 44 includes an elevator 52 for suspending pipe 14, a handling ring 54, a pair of elevator links 56 for suspending elevator 52 from handling ring 54, a swivel bearing housing 58 for receiving swivel bearing 48 and rotatably supporting handling ring 54, a make-break device 60 and grabs 62 supported from handling ring 54 by means of a structural support (not shown), and a pair of support links 68 for suspending swivel bearing housing 58 from a counterbalance 70. Drill motor 46 is mounted on a frame 72 including support rollers 74 for engagement for guide tracks 32.

Means for suspending power swivel 12 within derrick 24 include a traveling block 64 and a traveling beam 66 mounted at the bottom of traveling block 64.

Well 20 is deepened by rotating drill string 18 by drill motor 46 until the top end of drill pipe 14 descends to near rig floor 26. During drilling, some of the weight of the drill string 18 is supported at the bottom of well 20 by bit 22 and the remainder supported by traveling block 64. When the upper end of pipe 14 reaches floor 26, drilling by motor 46 is stopped. Drill string 18 is engaged by slips 30 to support the entire weight of drill string 18. Grabs 62 are secured to the upper end of pipe 14 and make-break device 60 is secured to sub assembly 50. Grabs 62 prevent rotation of drill string 18 (pipe 14 is now downhole in well 20 forming part of drill string 18) while make-break device 60 rotates sub assembly 50 and breaks the joint between sub assembly 50 and pipe 14. Alternatively, this joint could be broken by reversing drill motor 46. Sub assembly 50 is "spun out" or disconnected from drill string 18. As the thread of the bottom portion of sub assembly 50 disengages the thread of the upper end of drill string 18, the uplift tension of counterbalance 70 causes power swivel 12 to abruptly pull away from drill string 18.

When drilling deep wells, such as oil wells, various reasons may necessitate the removal of a drill string. For example, drill bit 22 may become excessively worn requiring replacement. Drill bit 22 is replaced by removing drill string 18 from well 20. Drill string 18 is removed from well 20 by sequentially pulling a portion of drill string 18 above floor 26 corresponding in length to the stand of pipe 14 (about 27 meters) shown in FIG. 1 from well 20 by traveling block 64. As described above, slips 30 engage drill string 18 and make-break device 60 and grabs 62 are used to disconnect sub assembly 50 from pipe 14. After sub assembly 50 is disengaged from the upper end of pipe 14, power swivel 12 is raised by traveling block 64 until elevator 52 suspended from the bottom of elevator links 56 engages the shoulders of tool joint 16 connected to the upper end of pipe 14. A torque wrench (not shown) at floor 26 of derrick 24 is engaged with the upper end of drill string 18 (on tool joint 16) and breaks joint 16 loose. Pipe 14 is rotated by a spinning means at floor 26 (not shown) to disconnect pipe 14 from drill string 18.

After pipe 14 is disengaged from drill string 18, pipe 14 is lifted in derrick 24 and placed in a storage rack (not shown) as is well known. Successive lengths of pipe 14 are removed until drill string 18 is completely removed from well 20. A new bit 22 is connected to the bottom end of drill string 18 which is lowered by traveling block 64 into well 20 where drill string 18 is supported by slips 30. For reassembly of drill string 18, the sequence is reversed. Another stand of pipe is secured from the storage rack, suspended from elevator 52, and lowered by traveling block 64 until the bottom end of pipe 14 engages the upper end of drill string 18. As indicated above, power swivel 12 is controlled remotely by an operator from a console on rig floor 26. The operator must deliberately overshoot the initial point of contact to insure the threads will make up when threading in adjacent ends. Because the operator's line of sight may be obstructed and because the response time of the control means limits sensitivity, adjacent ends between drill string 18 or drill pipe 14 and sub assembly 50 may be impacted abruptly against one another. Without our counterbalance, the full weight of the power swivel would be rapidly applied to the impacted surfaces. The threaded end of either member may be damaged requiring rethreading.

A preferred embodiment of our active counterbalance 70 is shown in detail in FIGS. 3-6 and will now be described. The weight of power swivel 12 and any pipe 14 suspended from elevator 52 is supported by support links 68. Traveling beam 66 is secured to traveling block 64 by bolts 76 and is coupled on each end to support links 68 by a slotted frame 78. Since the coupling at each end of traveling beam 66 is identical, only one end will be described. Frame 78 includes a slot 80 for receiving a keyed portion 82 of traveling beam 66. Frame 78 is rigidly connected to traveling beam 66 by welding inside surfaces 79 of frame 78 to key 82. Support links 68 are coupled to traveling block 64 by passing a support pin 84 (FIG. 3) through an eyelet 69 (FIG. 4) with support pin 84 positioned in slot 80 of frame 78. Support pin 84 is slidably retained in slot 80 by a pair of end caps 86 disposed on opposite sides of frame 78 with caps 86 connected to pin 84 by bolts 88.

Figure 5:
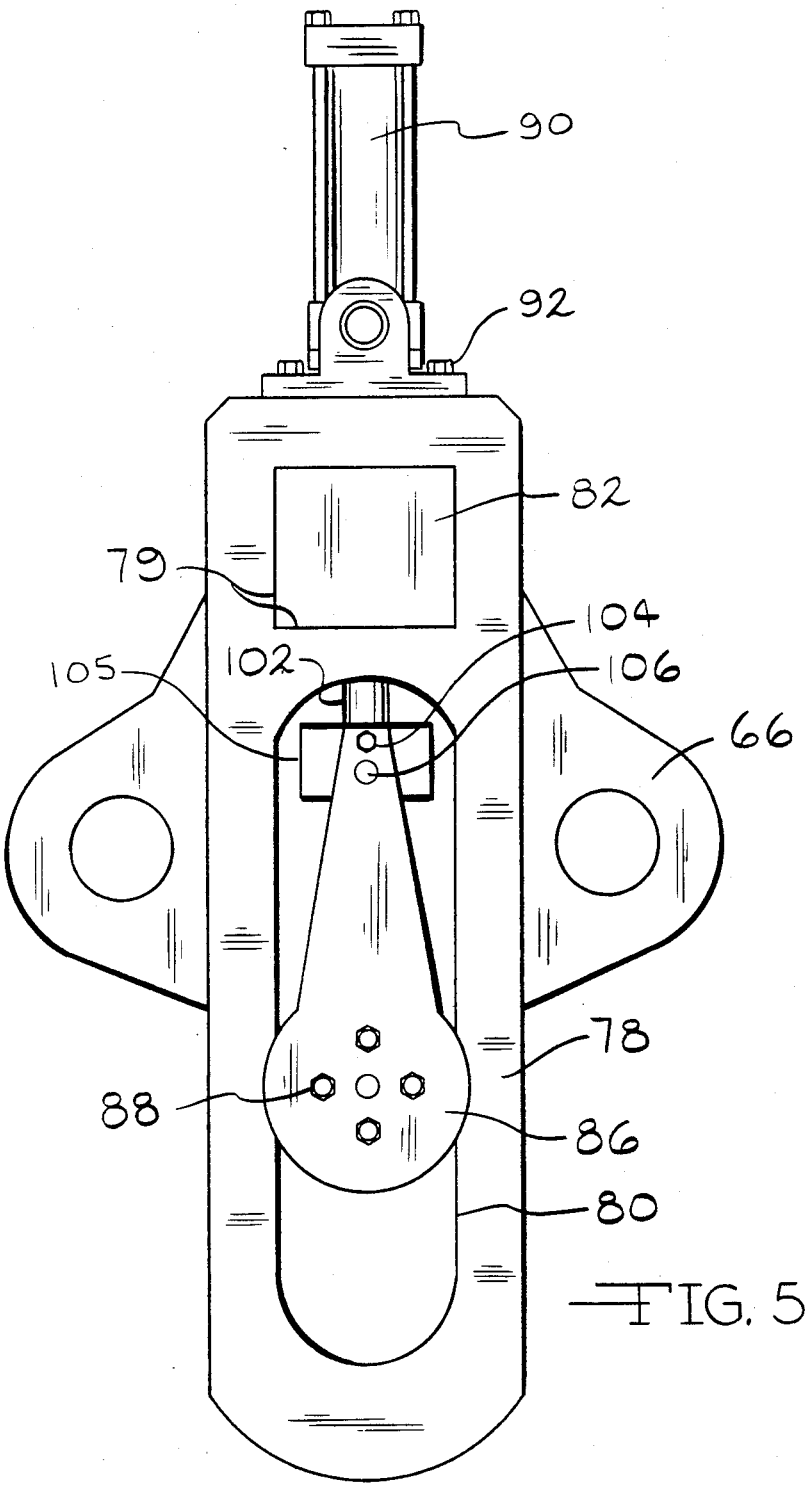
FIG. 5 is a side view of one position of the counterbalance shown in FIG. 4.

As shown in FIGS. 3-6, a single acting hydraulic motor 90 provides means for biasing the load capacity of counterbalance 70 and is mounted on top of each frame 78 by bolts 92 (FIG. 5). Each motor 90 is hydraulically connected by a line 94 to an accumulator 96. Accumulator 96 is connected by a line 98 to an air drive hydraulic pump 100 for adjusting pressure on motors 90. Pump 100 is operated remotely from the console.

Figure 6:
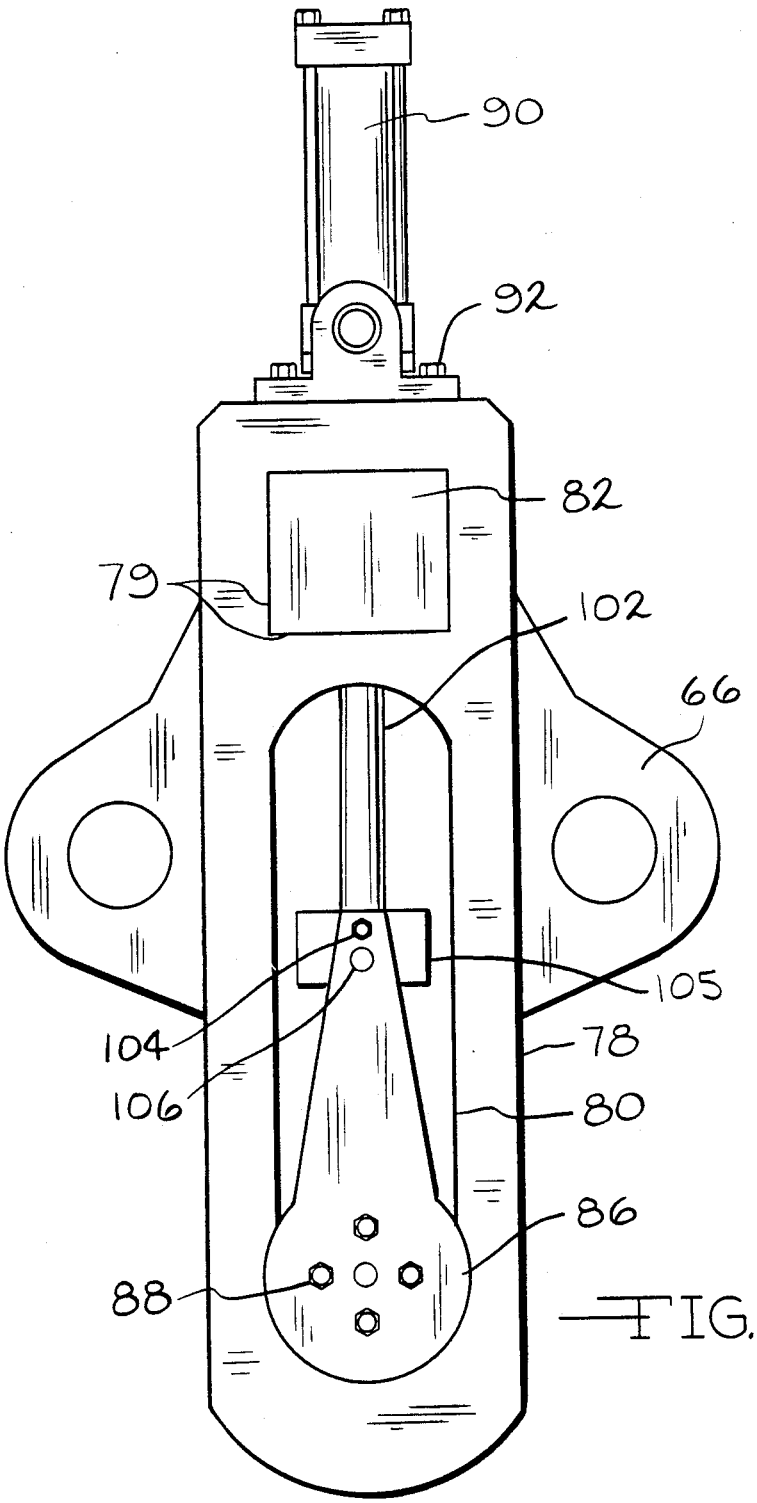
FIG. 6 is a side view showing another position of the counterbalance shown in FIG. 4.

Referring now to FIGS. 5 and 6, key 82 of traveling beam 66 is bored for receiving a piston rod 102. Piston rod 102 extends from hydraulic motor 90 and is connected to end caps 86 by a bolt 104 and a shear pin 106 via a load supporting beam 105.

The purpose of our counterbalance 70 is to support the weight of power swivel 12 and any pipe 14 suspended from elevator 52. The weight will depend on the power swivel used but will normally be less than 50,000 lb. (22,680 kg). Of course, drill string 18 will normally greatly exceed this weight, weighing as much as 400,000 lb (181,500 kg.). Therefore, when power swivel 12 supports drill string 18, such as during drilling or when spinning drill string 18 into or out of well 20, the load capacity of counterbalance 70 is greatly exceeded and overridden with support pin 84 positioned at the bottom of slot 80 in frame 78, e.g. FIGS. 3, 4 and 6.

As indicated above, the weight of power swivel 12 is previously known. A pressure on motors 90 to exactly balance this weight is easily determined knowing the working area of hydraulic motors 90. For example, for two motors 90 having a working area of about 12.57 $in^2$ (81 $cm^2$), a pressure of about 1990 psi (13.7 $N/mm^2$) on each motor 90 will support a load of approximately 50,000 pounds (22,680 kg). By adjusting the pressure of each motor 90 by pump 100 to a pressure slightly less than the balancing pressure, say 1950 psi (13.4 $N/mm^2$), support pins 84 (support links 68) will be displaced downwardly to the position shown in FIGS. 3, 4 and 6. This is the first or extended position. If the pressure of each motor 90 is slightly increased to a pressure greater than the balancing pressure, say 2050 psi (14.1 $N/mm^2$), counterbalance 70 will support the weight of power swivel 12. Support links 68 slowly will be displaced upwardly to a retracted position, such as the position shown in FIG. 5. It will be understood that the retracted or second position of pins 84 could be anywhere above the bottom of slot 80 depending upon the amount of the operator's overshoot.

We will now describe the operation of our invention. When it becomes necessary to connect new pipe 14 to drill string 18, pipe 14 will be secured from the storage rack and suspended from elevator 52. The weight of power swivel 12 will be known and corresponds to a balancing pressure P. At any point prior to or while suspending pipe 14 from elevator 52, the pressure on each motor 90 of counterbalance 70 is adjusted to a pressure $P_h$ which is slightly greater than the balancing prssure P but less than that necessary to support both the weight of power swivel 12 and pipe 14. Since counterbalance 70 cannot quite support the weight of power swivel 12 and drill pipe 14, support pins 84 will be displaced downwardly until engaging the bottom of slot 80 in frame 78. Counterbalance 70 is in an extended position shown in FIGS. 3, 4 and 6. Pipe 14 is lowered in derrick 24 by traveling block 64 until the lower end of pipe 14 contacts the upper end of drill string 18 displacing pins 84 from the extended position to the retracted position such as shown in FIG. 5. Without our counterbalance 70, the threads and sealing surfaces between adjacent ends of pipe 14 and drill string 18 would be loaded with the weight of power swivel 12 and drill pipe 14. However, because motors 90 are under pressure $P_h$ (greater than the balancing pressure P), the adjacent ends of pipe 14 and drill string 18 "softly" engage one another with a load less than that of the weight of drill pipe 14. With drill string 18 being held by the torque wrench, pipe 14 is rotated by the spinner means (not shown) on floor 26 and threadably connected to drill string 18 displacing pins 84 of counterbalance 7 towards the original extended position. Either while pipe 14 is being connected to drill string 18 or after the connection has been made, the pressure on each motor 90 is adjusted to a pressure $P_l$ which is slightly less than the balancing pressure P. Since counterbalance 70 is already in an extended position, the pistons of motors 90 remain near the extended position shown in FIGS. 3, 4 and 6. Power swivel 12 is lowered by traveling block 64 until sub assembly 50 engages the top end of drill pipe 14. Without our activated counterbalance 70, the threads and sealing surfaces of drill pipe 14 and sub assembly 50 would be loaded with the weight of power swivel 12 when sub assembly 50 is lowered into engagement with the upper end of drill pipe 14. Because motors 90 are under pressure $P_l$ (only slightly less than the balancing pressure P), sub assembly 50 "softly" engages drill pipe 14. When sub assembly 50 engages pipe 14, the pistons of motors 90 will be displaced upwardly to a retracted position such as shown in FIG. 5. Support pins 84 are displaced upwardly in slots 80 of frames 78 until the downward movement of traveling block 64 is stopped. Damage to the sub assembly 50 and drill pipe 14 are thereby prevented. Drill pipe 14 is held by make-break device 60 and sub assembly 50 is connected to pipe 14 by being rotated by drill motor 46. Alternatively, drill string 18 could be held by the torque wrench at rig floor 26 and drill string 18, pipe 14, and sub assembly 50, all connected simultaneously by rotation of drill motor 46. In any event, as sub assembly 50 is threaded into pipe 14, sub assembly 50 is pulled downwardly displacing support pins 84 from the upper position to the lower or extended position.

If drill bit 22 must be replaced, surveying of well 20 required, or casing needs to be run, drill string 18 is pulled from well 20 by traveling block 64 a distance above floor 26 corresponding to a length of a stand of drill pipe 14. Drill string 18 is then supported by slips 30. The upper end of pipe 14 is disconnected from sub assembly 50 and then the bottom end of pipe 14 is disconnected from drill string 18 as described above. At any point prior to disconnecting pipe 14 from drill string 18, the pressure on motor 90 is adjusted to pressure $P_h$ which is slightly greater than the balancing pressure P. Still drill motor 46 is still connected via sub assembly 50 to drill pipe 14, support pin 84 is still bottomed out (FIGS. 3, 4 and 6) in slot 80 of frame 78 at this time. Pipe 14 is held by grabs 62 and sub assembly 50 is rotated by make-break device 60. As sub assembly 50 is disconnected from the upper end of pipe 14, support pin 84 is displaced upwardly such as illustrated in FIG. 5 thereby vertically pulling power swivel 12 away from pipe 14. As piston rod 102 is displaced upwardly, a piston 108 forces hydraulic fluid from motor 90 into an atmospheric tank through an orifice. Power swivel 12 thereby becomes critically dampened preventing rebound and impact damage to either of the threaded connections. Traveling block 64 is now raised until elevator 52 engages tool joint 16 on the upper end of pipe 14. Support pin 84 will again become displaced downwardly and seated at the bottom of slot 80 in frame 78. Pressure $P_h$ on motors 90 will be increased by an amount to also support the weight of pipe 14 to a pressure $P_{h2}$. The weight of pipe 14 generally is about 1800 lb. (817 kg). Drill string 18 is then held by the torque wrench and pipe 14 is rotated by the spinner means at floor 26. When pipe 14 is disconnected from drill string 18, support pin 84 is displaced upwardly thereby vertically pulling power swivel 12 and pipe 14 away from drill string 18 with power swivel 12 being critically damped as described above. Pipe 14 is now placed in a storage rack by elevator links 56. For removing subsequent stands of pipe 14 from drill string 18 when tripping out, power swivel 12 is lowered by traveling block 64 for engaging elevator 52 with tool joint 16 of the next stand of pipe 14 to be removed. The pressure on motors 90 remains at $P_{h2}$ until all the stands of pipe 14 are removed from well 20. Of course, when drill string 18 is to be reassembled i.e. tripping in, the pressure on motors 90 will be decreased to a pressure less than that required to support the weight of power swivel 12 and drill pipe 14 e.g. $P_h$.

Alternatively, prior to disconnecting sub assembly 50 from pipe 14, the pressure of counterbalance 70 could be adjusted directly to pressure $P_{h2}$. Depending on the initial position of elevator 52 relative to tool joint 16 when sub assembly 50 is disconnected from the upper end of pipe 14, elevator 52 may be displaced upwardly into contact with tool joint 16 when sub assembly 50 is disconnected from pipe 14, without raising traveling block 64. This would allow the driller to disconnect the upper and lower joints of pipe 14 without readjusting the pressure.

In the description above for adding a stand of drill pipe to a drill string, the sub assembly was connected to the upper end of the drill pipe after making the connection between the drill string and the drill pipe. It will be understood the sequence could be reversed. For example, when adding a stand of pipe to a drill string, the connection could first be made between the pipe and the sub assembly using a procedure similar to that described above. In this sequence, the load supporting pressure on motors 90 is adjusted to pressure $P_h$ which is less than that required to support the weight of power swivel 12 and drill pipe 14. Pins 84 of counterbalance 70 will be seated in the bottom of slots 80 in frames 78. When pipe 14 is lowered into engagement with drill string 18, support pin 84 will be displaced upwardly from the extended position at the bottom of slot 80 in frame 78. In other words, pipe 14 and power swivel 12 will move upwardly relative to traveling block 64. Prior to lowering sub assembly 50 into contact with the upper end of pipe 14, the pressure on motors 90 is adjusted to pressure $P_l$ slightly less than that required to support the weight of power swivel 12. The load supporting force need not include an increment for supporting pipe 14 since pipe 14 is now resting on drill string 18 which is supported by slips 30. Power swivel 12 is now lowered by traveling block 64 until sub assembly 50 contacts the upper end of pipe 14. Adjacent ends between drill string 18, pipe 14 and sub assembly can be connected simultaneously. Similarly, when pipe 14 is disconnected from drill string 18, the connection between pipe 14 and drill string 18 could be broken first. If so, prior to breaking the connection, the load capacity of counterbalance 70 will be adjusted to greater than the weight of power swivel 12 and pipe 14 by adjusting the pressure to motors 90 to pressure $P_{h2}$. When pipe 14 is disconnected from drill string, the uplift tension (upward force of piston 108) causes power swivel 12 and pipe 14 to be pulled away from drill string 18. Sub assembly 50 can then be disconnected from drill pipe 14.

Figure 7:
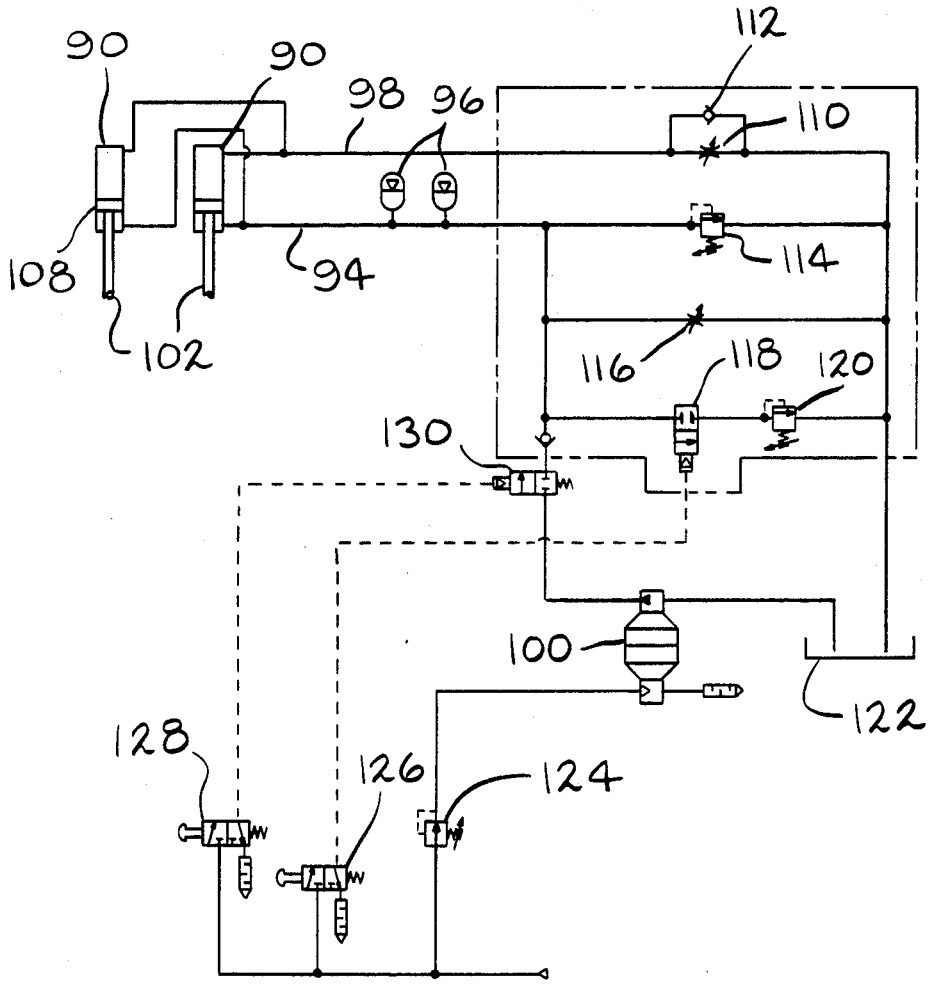
FIG. 7 is a schematic view of the hydraulic circuitry of our active counterbalance.

FIG. 7 illustrates a preferred embodiment of the hydraulic circuitry of our counterbalance 70. In addition to motors 90, accumulators 96 and pump 100, the counterbalance may include a needle valve 110 with a bypass check valve 112, a system relief valve 114, a bleed down valve 116, a directional valve 118, another relief valve 120, an oil supply tank 122 and a pressure regulator 124. Valve 110 dampens the motion of the power swivel to prevent rebound. Valve 112 allows rapid counterbalancing of a load when traveling beam 66 is being displaced upwardly at the moment a threaded disconnection has been made. Relief valve 114 prevents over pressuring the entire hydraulic system. Bleed down valve 116 allows pressure in accumulators 96 to be relieved when servicing the hydraulic system. Valve 118 either allows or prevents system pressure to pass to relief valve 120. For a given load, the minimum pressure $P_l$ is set at relief valve 120. Pressure of the counterbalance is set by regulator 124. A driller remotely operates the system from the console by actuating a controller 126 for lowering the pressure or actuating a controller 128 for locking the pressure. A remotely controlled valve 130 can be used to shut off pump 100 if the pressure of relief valve 120 is set at a pressure that is lower than pump 100.

When a threaded connection is to be made, e.g. connecting sub assembly 50 to pipe 14, relief valve 120 allows the pressure on motors 90 to be reduced i.e. $P_l$. The weight of power swivel 12 displaces pistons 108 in motors 90 downwardly forcing hydraulical fluid through line 94 to relief valve 120. When a connection is to be broken, pump 100 is actuated by regulator 124 until the pressure is increased to $P_h$. As soon as the disconnection is made, pressurized fluid from accumulators 96 moves through line 94 causing pistons 108 to be displaced upwardly in motors 90. Fluid is forced from the top of motors 90 through line 98 through needle valve 110 and ultimately back to supply tank 122.

As described above, our invention includes an active counterbalance wherein the load capacity of the counterbalance is adjusted. When a stand of pipe is to be added to a drill string, the load capacity of the counterbalance is adjusted to slightly less than the weight of the power swivel and the pipe. The power swivel, i.e. the pistons of the hydraulic motors, will be displaced downwardly to a fully extended position. When the pipe is lowered into engagement with the drill string, the pistons are displaced upwardly relative to the traveling block. Damage to the connecting surfaces is prevented by the soft engagement because most of the load of the power swivel and the pipe is transferred to the counterbalance rather than the threads. A small pressure difference between pressures P and $P_h$, e.g. 50 psi (0.3 $N/mm^2$) in the above example, is all that is required to "float" or displace the weight of the power swivel.

It will be understood that various modifications can be made to our invention without departing from the spirit and scope of it. For example, any number, size or type of motors may be used depending on the load to be supported. Furthermore, the displacement distance of the pistons can be varied depending on operator visibility and control means sensitivity. Therefore, the limits of our invention should be determined from the appended claims:

We claim:

1. For use in a derrick, the combination comprising:
a power swivel for rotation of a drill string,
said power swivel including,
a motor drive assembly for rotating said drill string,
a handling system for supporting a drill pipe,
means for supporting said power swivel, an active counterbalance connecting said power swivel to said support means and operable to permit vertical displacement of said power swivel between first and second positions,
said counterbalance including a motor,
said motor providing means for biasing the load capacity of said counterbalance when supporting said power swivel to vertically displace said power swivel relative to said support means between said first and second positions,
said biasing means being in said first position when the force on said biasing means is adjusted to a force less than that required to support said power swivel and in said second position when the force on said biasing means is adjusted to a force greater than that required to support said power swivel.

2. The power swivel of claim 1 wherein said counterbalance includes a pump, an accumulator and a hydraulic motor, said biasing means including a piston and a piston rod.

3. The power swivel of claim 1 wherein said handling system includes a handling ring, an elevator for supporting said drill pipe, and a pair of elevator links for suspending said elevator from said handling ring.

4. The power swivel of claim 3 wherein said handling system includes a swivel bearing housing for receiving said motor drive assembly, said handling ring being rotatably supported by said swivel bearing housing.

5. The power swivel of claim 2 wherein said support means includes a traveling block for supporting said hydraulic motor.

6. The power swivel of claim 5 wherein said handling system includes a swivel bearing housing, said swivel bearing housing suspended from said hydraulic motor by a support link.

7. The power swivel of claim 5 wherein a traveling beam is supported by said traveling block, said hydraulic motor of said counterbalance mounted onto said traveling beam.

8. The power swivel of claim 7 wherein said counterbalance includes
a pair of said hydraulic motors,
said hydraulic motors mounted on opposite ends of said traveling beam.

9. The power swivel of claim 8 wherein said pump and said accumulator are mounted on said traveling block.

10. The mounted swivel of claim 8 wherein said counterbalance includes a pair of slotted frame members, said frame members connected to said opposite ends of said traveling beam, a support pin received by the slot of each said frame member, said support pin connected to said piston rod of each said hydraulic motor, said support pin at the bottom of said slot when said piston is in said first position, said support pin displaced upwardly from said bottom of said slot when said piston is in said second position.

11. For use in a derrick, the combination comprising:
a power swivel for rotation of a drill string,
said power swivel including,
a motor drive assembly for rotating said drill string,
a handling system for supporting a drill pipe,
means for supporting said power swivel,
said support means including,
a traveling block,
a traveling beam mounted on said traveling block,
an active counterbalance for connecting said power swivel to said support means,
said counterbalance including,
a pump,
an accumulator,
a pair of hydraulic motors,
each of said hydraulic motors mounted on opposite ends of said traveling beam,
each of said hydraulic motors including a piston having first and second positions,
said pistons being in said first position when the pressure by said pump is adjusted to a pressure less than that required to support said power swivel,
said pistons being in said second position when the pressure by said pump is adjusted to a pressure greater than that required to support said power swivel.

12. The power swivel of claim 11 wherein the handling system includes,
a swivel bearing housing for receiving said motor drive assembly,
a handling ring connected to said swivel bearing housing,
an elevator for supporting said drill pipe,
a pair of elevator links for suspending said elevator from said handling ring,
a pair of support links for suspending said swivel bearing housing from said hydraulic motors.

13. A method for assembling a drill string in a derrick including,
a power swivel for rotation of the drill string,
the power swivel including,
a motor drive assembly for rotation of the drill string, the motor drive assembly including a sub assembly for threadable connection to a drill pipe,
a handling system for supporting the drill pipe,
means for supporting the power swivel,
an active counterbalance for connecting the power swivel to the support means,
the counterbalance including a motor providing means for biasing the load capacity of the counterbalance when supporting the power swivel thereby providing for vertical displacement of the power swivel relative to the support means between first and second positions,
the method comprising the steps of:
adjusting the supporting force on the motor to a first force less than that required to support the weight of the power swivel thereby displacing downwardly the biasing means to the first position,
lowering the sub assembly into contact with the drill pipe thereby displacing upwardly the biasing means to the second position,
threading the sub assembly into the drill pipe,
wherein high loading or impact between adjacent ends of the sub assembly and the drill pipe is prevented.

14. The method of claim 13 including the additional steps of:
adjusting said supporting force on the motor to a second force greater than that required to support the weight of the power swivel,
disconnecting the sub assembly from the drill pipe wherein the biasing means is displaced upwardly away from the drill pipe.

15. The method of claim 14 wherein the handling system includes an elevator for supporting the drill pipe, additional steps for disassembly of the drill string including:
adjusting said supporting force on the motor to a third force greater than said second force, the difference between said third force and
said second force substantially equal to the weight of the drill pipe, raising said elevator into contact with a tool joint connected to the upper end of the drill pipe,
displacing the biasing means from the second position to the first position,
disconnecting the drill pipe from the drill string wherein said elevator and the drill pipe are displaced upwardly away from the drill string.

16. The method of claim 14 wherein the handling system includes an elevator for supporting the drill pipe, including the additional steps of:
adjusting said supporting force on the motor to a force less than that required to support the weight of the power swivel and the drill pipe,
suspending the drill pipe from said elevator thereby displacing downwardly the biasing means to the first position,
lowering the drill pipe until contacting the drill string thereby displacing upwardly the biasing means toward the second position,
threading the drill pipe into the drill string.

17. The method of claim 16 wherein the sub assembly is threaded into the drill pipe after the drill pipe is threaded into the drill string.

18. The method of claim 13 wherein the motor of the counterbalance is a hydraulic motor,
adjusting said supporting force by changing the fluid pressure on said hydraulic motor.

19. A method for assembling a drill string in a derrick including,
a power swivel for rotation of the drill string,
the power swivel including,
a motor drive assembly for rotation of the drill string, the motor drill assembly including a sub assembly for threadable connection to a drill pipe,
a handling system for supporting the drill pipe, the handling system including an elevator for supporting the drill pipe,
means for supporting the power swivel,
an active counterbalance for connecting the power swivel to the support means, the counterbalance including a hydraulic motor having a shiftable piston, the method comprising the steps of:

suspending the drill pipe from the elevator, adjusting the pressure on the hydraulic motor to a pressure less than that required to support the weight of the power swivel and the drill pipe thereby displacing downwardly the piston to a first position, lowering the elevator until the drill pipe contacts the drill string thereby displacing upwardly the piston to a second position, threading the drill pipe into the drill string, adjusting the pressure on the hydraulic motor to a pressure less than that required to support the weight of the power swivel, lowering the sub assembly into contact with the drill pipe thereby displacing upwardly the piston to a second position, threading the sub assembly into the drill pipe wherein high loading or impact between adjacent ends of the sub assembly and the drill pipe is prevented.

20. The method of claim 19 including the additional steps of:

adjusting the pressure on the hydraulic motor to a pressure greater than that required to support the weight of the power swivel, disconnecting the sub assembly from the drill pipe wherein the piston is displaced upwardly toward said second position pulling the sub assembly away from the drill pipe.

21. A method for assembling a drill string in a derrick including, a power swivel for rotation of the drill string, the power swivel including, a motor drive assembly for rotation of the drill string, a handling system for supporting a drill pipe, means for supporting the power swivel, an active counterbalance for connecting said power swivel to said support means, the counterbalance including a motor providing means for biasing the load capacity of the counterbalance when supporting the power swivel thereby providing for vertical displacement of the power swivel relative to the support means between first and second positions, the method comprising the steps of:

adjusting the supporting force on the motor to a force less than that required to support the weight of the power swivel and the drill pipe, suspending the drill pipe from the handling system thereby displacing downwardly the biasing means to the first position, lowering the drill pipe until contacting the drill string thereby displacing upwardly the biasing means from the first position to the second position, threading the drill pipe into the drill string wherein high loading or impact between adjacent ends of the drill pipe and the drill string is prevented.

22. The method of claim 21 including the additional steps of sequentially connecting a plurality of the drill pipe to the drill string.

23. The method of claim 22 wherein the motor drive assembly includes a sub assembly including the additional steps of:

adjusting the supporting force on the motor to a force just less than that required to support the weight of the power swivel, lowering the power swivel until the sub assembly contacts the drill string thereby displacing upwardly the biasing means toward the second position, threading the sub assembly into the drill pipe.

* * * * *